US007185505B2

(12) United States Patent
Kamimura

(10) Patent No.: US 7,185,505 B2
(45) Date of Patent: Mar. 6, 2007

(54) REFRIGERANT CIRCUIT AND HEAT PUMP TYPE HOT WATER SUPPLY APPARATUS

(75) Inventor: Ichiro Kamimura, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 118 days.

(21) Appl. No.: 10/952,819

(22) Filed: Sep. 30, 2004

(65) Prior Publication Data

US 2005/0066678 A1 Mar. 31, 2005

(30) Foreign Application Priority Data

Sep. 30, 2003 (JP) ..... P2003-339529

(51) Int. Cl.
*F25B 27/00* (2006.01)

(52) U.S. Cl. ..... 62/238.7

(58) Field of Classification Search ..... 62/238.6, 62/238.7

See application file for complete search history.

(56) References Cited

U.S. PATENT DOCUMENTS

| | | | | |
|---|---|---|---|---|
| 4,399,664 | A * | 8/1983 | Derosier | 62/238.7 |
| 4,646,537 | A * | 3/1987 | Crawford | 62/238.6 |
| 4,796,437 | A * | 1/1989 | James | 62/79 |
| 5,269,153 | A * | 12/1993 | Cawley | 62/180 |
| 5,461,876 | A * | 10/1995 | Dressler | 62/160 |
| 5,669,224 | A * | 9/1997 | Lenarduzzi | 62/160 |
| 5,901,563 | A * | 5/1999 | Yarbrough et al. | 62/238.7 |
| 6,615,602 | B2 * | 9/2003 | Wilkinson | 62/238.7 |

* cited by examiner

*Primary Examiner*—William E. Tapolcai
(74) *Attorney, Agent, or Firm*—McDermott Will & Emery LLP

(57) ABSTRACT

In a heat pump type hot water supply apparatus having a compressor (16), an outdoor heat exchanger (22), an expansion valve (24) and at least one indoor heat exchangers, and a water heat exchanger (18) for heat-exchanging refrigerant and water to achieve hot water, the water heat exchanger (18) is equipped in the refrigerant circuit so as to be connected to the outdoor heat exchanger (22) in series in the refrigerant circuit.

7 Claims, 3 Drawing Sheets

REFRIGERANT CIRCUIT AND HEAT PUMP TYPE HOT WATER SUPPLY APPARATUS

BACKGROUND OF THE INVENTION

1. Field of the Invention

The present invention relates to a heat pump type hot water supply apparatus, and particularly to a heat pump type hot water supply apparatus which can perform an air conditioning operation and a hot water supplying operation with energy saving.

2. Description of the Related Art

A conventional heat pump type hot water supply apparatus is generally designed so that a heat exchanger of a hot water supply unit and an outdoor heat exchanger are arranged in parallel in a refrigerant circuit, and under cooling operation refrigerant circulating in the refrigerant circuit is cooled and condensed in both the heat exchanger of the hot water supply unit and the outdoor heat exchanger to cool the room.

FIG. 1 shows a conventional heat pump type hot water supply apparatus 10 (disclosed in JP-A-10-288420, for example). The heat pump type hot water supply apparatus 10 shown in FIG. 1 contains an outdoor unit 12, indoor units 14*a* and 14*b* and a hot water stock tank unit 50. The outdoor unit 12 includes a compressor 16, a four-way valve 52 connected to the refrigerant discharge side of the compressor 16, an outdoor heat exchanger 22 connected to the four-way valve 52 at one end thereof, and a first expansion valve 24 connected to the other end of the outdoor heat exchanger 22 at one end thereof. Each indoor unit 14*a* (14*b*) includes a second expansion valve 36*a* (36*b*) and an indoor heat exchanger 38*a* (38*b*). The second expansion valve 36*a* (36*b*) is connected to the first expansion valve 24, and the indoor heat exchanger 38*a* (38*b*) is connected to the four-wave valve 52.

Furthermore, a first electromagnetic valve 54 is equipped between the compressor 16 and the four-way valve 52, and the hot water stock tank unit 50 is disposed in a passage which extends so as to branch off a refrigerant pipe between the compressor 16 and the first electromagnetic valve 54 and link to the refrigerant pipe between the first expansion valve 24 and the second expansion valve 35*a* (36*b*). A third expansion valve 56 is equipped at the refrigerant outlet port of the hot water stock tank unit 50. That is, the hot water stock tank unit 50 is connected to the outdoor heat exchanger 22 in parallel in the refrigerant circuit.

When only cooling operation is carried out in the construction shown in FIG. 1, after the four-way valve 52 is switched as indicated by a solid line, the first expansion valve 24 is fully opened, and the second expansion valves 36*a*, 36*b* are opened at predetermined valve opening degrees. In addition, the third expansion valve 56 is fully closed, and the first electromagnetic valve 54 is opened. Under this state, the refrigerant discharged from the compressor 16 is circulated through the outdoor heat exchanger 22, the first expansion valve 24, the second expansion valves 36*a*, 36*b*, the indoor heat exchangers 38*a*, 38*b* and the accumulator 44 in this order.

On the other hand, when only heating operation is carried out, after the four-way valve 52 is switched as indicated by a broken line, the first expansion valve 24 is fully opened, and the second expansion valves 36*a*, 36*b* are opened at predetermined opening degrees. In addition, the third expansion valve 56 is fully closed, and the first electromagnetic valve 54 is opened. Under this state, the refrigerant discharged from the compressor 16 is circulated through the indoor heat exchangers 38*a*, 38*b*, the second expansion valves 36*a*, 36*b*, the first expansion valve 24, the outdoor heat exchanger 22 and the accumulator 44 in this order.

Furthermore, when hot-water supply operation is needed, the four-way valve 52 is switched as indicated by the broken line, the first expansion valve 24 is fully opened, the second expansion valves 36*a*, 36*b* are fully closed, the third expansion valve 56 is opened at a predetermined degree. The first electromagnetic valve 54 is closed, and the refrigerant discharged from the compressor 54 is circulated through a hot-water supply heat exchanger 58 of the hot water stock tank unit 50, the third expansion valve 56, the first expansion valve 24, the outdoor heat exchanger 22 and the accumulator 44 in this order. The refrigerant thus circulated is condensed in the hot-water supply heat exchanger 58, and evaporated in the outdoor heat exchanger 22, thereby enabling the hot water supply operation.

In the conventional heat pump type hot water supply apparatus described above, however, when both the cooling operation and the hot water supply operation or both the heating operation and the hot water supply operation are required to be carried out simultaneously, the refrigerant must be branched to two ways because the hot-water supply heat exchanger and the outdoor heat exchanger are arranged in parallel in the refrigerant circuit, resulting in reduction in efficiency. Furthermore, under cooling operation, the outdoor heat exchanger must be driven at all times.

SUMMARY OF THE INVENTION

Therefore, an object of the present invention is to provide a energy-saving type hot water supply apparatus which is designed so that refrigerant and water are heat-exchanged with each other at all times to thereby improve the cooling efficiency, and also uses exhaust heat from cooling for hot water supply. $CO_2$ refrigerant is inferior in the cycle efficiency of cooling operation at a higher outside air temperature as compared with HFC refrigerant, etc., however, this construction improves the cycle efficiency under cooling operation.

In order to attain the above object, according to a first aspect of the present invention, a refrigerant circuit comprising a compressor (16) for compressing refrigerant, a first heat exchanger (22) selectively functioning as any one of an evaporator for evaporating the refrigerant and a condenser for condensing the refrigerant, an expansion valve (24) for reducing the pressure of the refrigerant, and a second heat exchanger (36*a*, 36*b*) selectively functioning as the other of the evaporator and the condenser, which are connected in series to one another to thereby circulate the refrigerant in the refrigerant circuit, is characterized in that a third heat exchanger (18) for heat-exchanging the compressed refrigerant discharged from the compressor (16) with heat-exchange fluid is equipped in the refrigerant circuit so as to be connected to the first heat exchanger (22) in series in the refrigerant circuit.

According to the first aspect, the first heat exchanger (22) and the third heat exchanger (18) are connected in series in the refrigerant circuit, so that the whole heat exchange amount of the refrigerant circuit is increased and thus the heat exchange efficiency of an apparatus using the above refrigerant circuit is enhanced. Furthermore, a load imposed on each heat exchanger due to heat exchange is reduced, and thus energy saving can be performed.

In the above refrigerant circuit, the heat-exchange fluid medium is water, and the third heat exchanger (18) is a water heat exchanger for refrigerating the refrigerant discharged from the compressor with water to achieve hot water. In the third heat exchanger, the refrigerant and water are heat-exchanged to each other. Water has a higher heat exchange efficiency than fluid such as air or the like, and thus the heat exchange efficiency of the third heat exchanger is enhanced. Accordingly, the heat exchange efficiency of an apparatus using the above refrigerant circuit is enhanced, and also energy saving is further enhanced.

The above refrigerant circuit further comprises a hot water unit connected to the third heat exchanger to supply the third heat exchanger with water to be heat-exchanged with the refrigerant and stock hot water from the third heat exchanger.

According to a second aspect of the present invention, a heat pump type hot water supply apparatus having a refrigerant circuit comprising a compressor (16) for compressing refrigerant, an outdoor heat exchanger (22) selectively functioning as any one of an evaporator for evaporating the refrigerant and a condenser for condensing the refrigerant, an expansion valve (24) for reducing the pressure of the refrigerant, and at least one indoor heat exchangers (36*a*, 36*b*) selectively functioning as the other of the evaporator and the condenser, which are connected in series to one another to thereby circulate the refrigerant in the refrigerant circuit, and a water heat exchanger (18) for heat-exchanging the compressed refrigerant discharged from the compressor (16) with water to achieve hot water, is characterized in that the water heat exchanger (18) is equipped in the refrigerant circuit so as to be connected to the outdoor heat exchanger (22) in series in the refrigerant circuit.

According to the second aspect of the present invention, the first heat exchanger, the outdoor heat exchanger and the water heat exchanger are connected to each other in series, and thus the water heat exchanger achieves hot water at all times. Accordingly, the apparatus of the second aspect can achieve both an air conditioning function and a hot water supply function in low cost.

The above heat pump type hot water supply apparatus further comprises a hot water stock tank (30) for stocking hot water, wherein the hot water stock tank (30) is connected to the water heat exchanger (18) to supply water to the water heat exchanger (18), the water supplied to the water heat exchanger (18) being heat-exchanged with the refrigerant discharged from the compressor to be heated, thereby providing an air conditioning function and a hot water supply function to the heat pump type hot water supply apparatus.

In the above heat pump type hot water supply apparatus, the refrigerant circuit contains a first refrigerant passage disposed between the water heat exchanger (16) and the expansion valve (24) so as to contain the outdoor heat exchanger, a second refrigerant passage disposed in the refrigerant circuit so as to bypass the outdoor heat exchanger, a third passage extending from a connection point between the first heat exchanger and the second refrigerant passage to the indoor heat exchangers (38*a*, 38*b*), a third passage extending from the compressor (16) through the water heat exchanger (18) to the connection point between the first refrigerant passage and the second refrigerant passage, and a switching unit (20, 28, 42*a*, 42*b*) for selecting any one of the first, second and third passages as a passage through which the refrigerant flows.

According to the above heat pump type hot water supply apparatus, for example when a large heat exchange amount is needed to rapidly cool the room or the like, the first passage is selected, and when a sufficient heat exchange amount is achieved through heat exchange in the water heat exchange, the second passage is selected. Therefore, the air conditioning operation can be properly carried out in accordance with a needed heat exchange amount.

In the above heat pump type hot water supply apparatus, the switching unit (20, 28, 42*a*, 42*b*) comprises electromagnetic valves (20, 28, 42*a*, 42*b*) disposed in the first, second and third passages.

The above heat pump type hot water supply apparatus further comprises a temperature detecting unit (48) for detecting refrigerant temperature at a refrigerant outlet port of the water heat exchanger, and a controller for controlling the switching unit on the basis of an output from the temperature detecting unit.

According to the above heat pump type hot water supply apparatus, the switching unit such as the electromagnetic valves (20, 28, 42*a*, 42*b*) is controlled on the basis of the refrigerant temperature at the outlet port of the water heat exchanger, and thus it can be judged whether the driving of the outdoor heat exchanger is needed or not and whether the outdoor heat exchanger should be bypassed or not. On the basis of the above judgment, the switching operation of the switching unit is controlled, so that the energy saving effect can be surely achieved.

DETAILED DESCRIPTION OF THE PREFERRED EMBODIMENTS

Preferred embodiments according to the present invention will be described hereunder with reference to the accompanying drawings.

Figure 1:
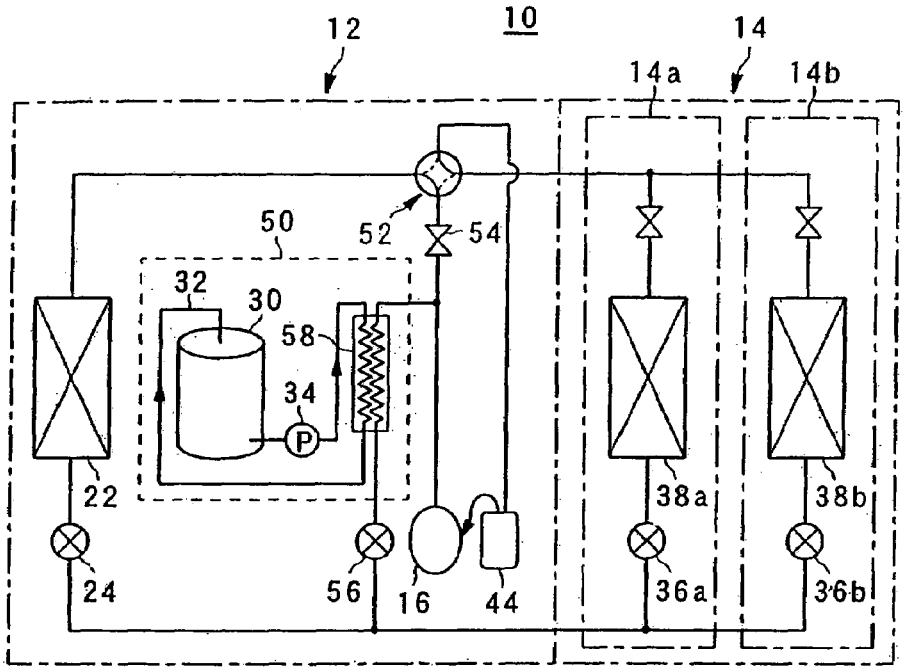
FIG. 1 (PRIOR ART)
FIG. 1 is a refrigerant circuit of a conventional heat pump type hot water supply apparatus.
Figure 2:
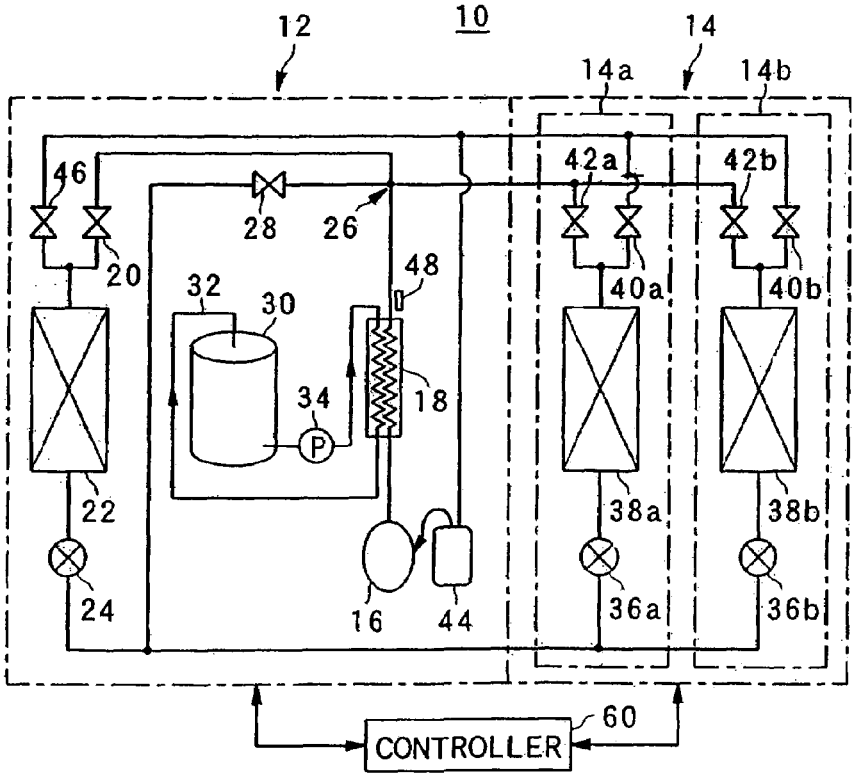
FIG. 2 is a refrigerant circuit of a heat pump type hot water supply apparatus according to an embodiment of the present invention.

FIG. 2 is a refrigerant circuit diagram of a heat pump type hot water supply apparatus using $CO_2$ refrigerant, and the heat pump type hot water supply apparatus 10 has a heat-source side unit (for example, outdoor unit) 12 and a user-side unit (for example, indoor unit) 14. The heat-source side unit 12 contains a compressor 16, a gas cooler 18 connected to the refrigerant discharge side of the compressor 16, a first electromagnetic valve 20, an outdoor heat exchanger 22, and a first expansion valve 24 which are connected to the user-side unit 14 through a refrigerant pipe indicated by a solid line in this order.

A four-way branched passage (pipe) 26 at which the refrigerant pipe is branched to four ways is disposed between the gas cooler 18 and the first electromagnetic valve 20, and in the heat-source side unit 12 one refrigerant pipe branched from the four-way branched passage 26 is connected through the third electromagnetic valve 28 to the refrigerant pipe extending from the first expansion valve 24 and connecting to the user-side unit 14.

A hot water stock tank 30 is equipped in the heat-source side unit 12, and a water pipe 32 is equipped in the heat-source side unit 12 so that water in the hot water stock tank 30 can be heat-exchanged with the refrigerant in the gas cooler 18. A pump 34 for circulating the water through the water pipe 32 is disposed in the water pipe 32 penetrating through the gas cooler 18. The pump 34 may be used to adjust the flow rate of water. Furthermore, since a temperature gradient occurs in water in the hot water stock tank 30 so that the water has high temperature at the upper portion and low temperature at the lower portion, the water of the lower temperature at the lower portion of the hot water stock tank 30 is taken out by the pump 34, and then heat-exchanged in the gas cooler 18.

The user-side unit 14 has two indoor units 14*a* and 14*b*, and each indoor unit 14*a* (14*b*) comprises a second expansion valve 36*a* (36*b*) connected to the first expansion valve 24 and the third electromagnetic valve 28, an indoor heat exchanger 38*a* (38*b*) connected through the refrigerant pipe to the second expansion valve 36*a* (36*b*), a fourth electromagnetic valve 40*a* (40*b*) and a fifth electromagnetic valve 42*a* (42*b*) disposed in parallel to the fourth electromagnetic valve 40*a* (40*b*).

The refrigerant pipe from the fourth electromagnetic valve 40*a* (40*b*) serves to connect the user-side unit 14 and the heat-source side unit 12 to each other and is connected to the suction side of the compressor 16 through the accumulator 44. The refrigerant pipe from each fifth electromagnetic valve 42*a* (42*b*) is connected to the last one end of the four-way branched passage 26. That is, the refrigerant piles connected to the gas cooler 18, the first electromagnetic valve 20, the third electromagnetic valve and the fifth electromagnetic valves 42*a*, 42*b* extend from the four-way branched passage 26.

In the heat-source side unit 12, a branch path is provided to the refrigerant pipe for connecting the fourth electromagnetic valves 40*a*, 40*b* and the accumulator 44, and it is connected to the outdoor heat exchanger 22 through the second electromagnetic valve 46, thereby forming the overall refrigerant circuit.

In this embodiment, the two indoor units are provided, however, the number of the indoor units is not limited to two. That is, one or three or more indoor units may be provided. Furthermore, in connection with the number of indoor units, the number of each of the indoor heat exchangers 38, the second expansion valves 36, the fourth and fifth electromagnetic valves 40 and 42 is varied, and the respective indoor units are connected to the heat-source side in parallel in the refrigerant circuit.

First Embodiment

Figure 3:
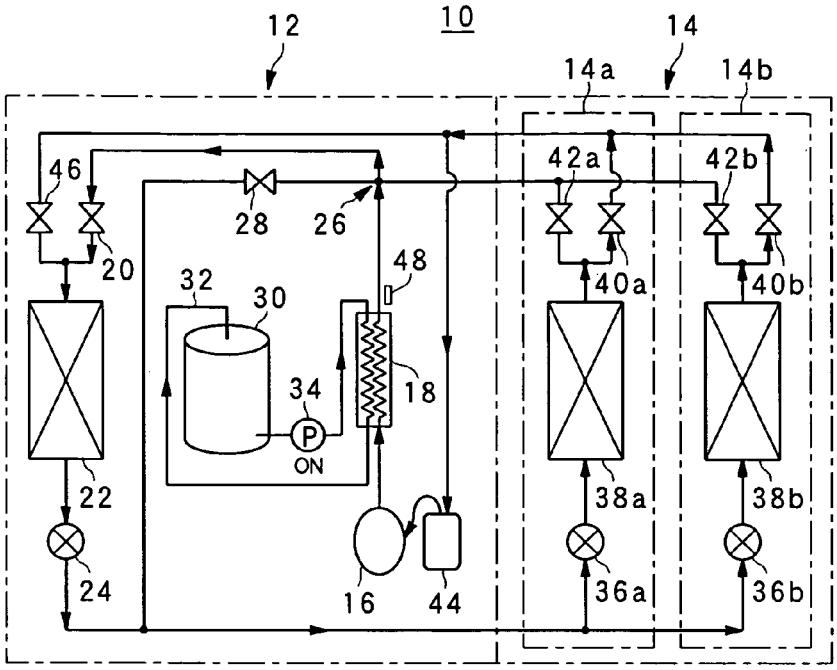
FIG. 3 is a refrigerant circuit showing refrigerant flow when a temperature sensor indicates a value higher than the outside air temperature under cooling operation in the heat pump type hot water supply apparatus of the embodiment.

Under cooling operation, the first and second expansion valves 24, 36*a*, 36*b* are opened, the first and fourth electromagnetic valves 20, 40*a*, 40*b* are opened, and the second, third and fifth electromagnetic valves 46, 28, 42*a* and 42*b* are closed as shown in FIG. 3. The refrigerant discharged from the compressor 16 is once cooled in the gas cooler 18, and reaches the four-way branched passage 26. Here, since the third and the fifth electromagnetic valves 28, 42*a* and 42*b* are closed, the refrigerant flows to the first electromagnetic valve 20, and is further cooled and condensed in the outdoor heat exchanger 22. The refrigerant thus condensed flows from the first expansion valve 24 to the second expansion valves 36*a* and 36*b* because the third electromagnetic valve 28 is closed, and is evaporated in the indoor heat exchangers 38*a* and 38*b*. The evaporation of the refrigerant in the indoor heat exchangers 38*a* and 38*b* allows the user-side units 14*a* and 14*b* to carry out the cooling operation.

When only the indoor unit 14*a* is driven to carry out the cooling operation and the indoor unit 14*b* is not driven, the second expansion valve 36*b* at the indoor unit 14*b* side may be closed. On the other hand, when only the indoor unit 14*b* is driven to carry out the cooling operation and the indoor unit 14*a* is not driven, the second expansion valve 36*a* at the indoor unit 14*a* side may be closed likewise. Accordingly, only the indoor unit requested can be driven to carry out the cooling operation.

The evaporated refrigerant is passed through the fourth electromagnetic valves 40*a* and 40*b* and returned to the heat-source side unit 12 because the fifth electromagnetic valves 42*a* and 42*b* are closed. Finally, since the second electromagnetic valve 46 is closed, the refrigerant is made to flow to the accumulator 44, and circulated in the refrigerant circuit.

Figure 4:
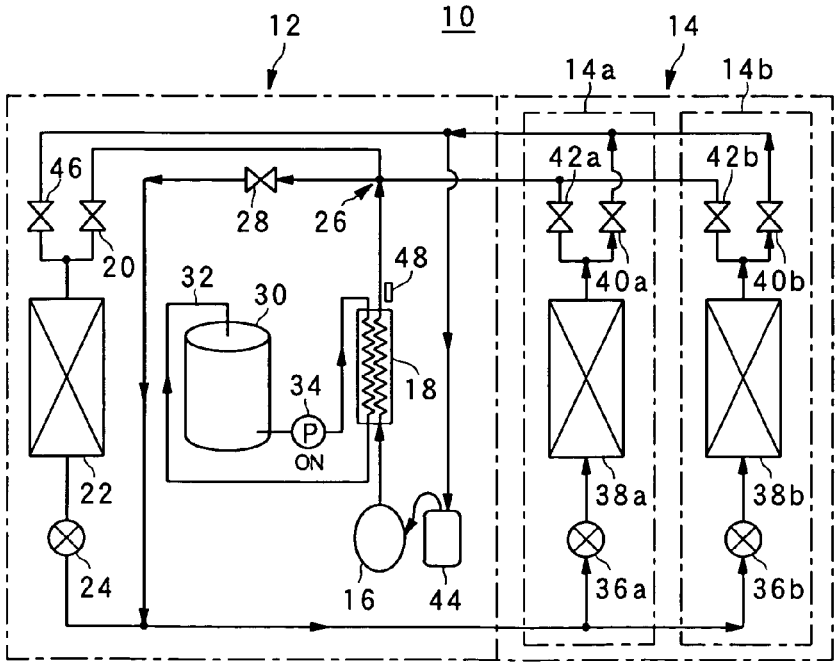
FIG. 4 is a refrigerant circuit showing refrigerant flow when the temperature sensor indicates a value lower than the outside air temperature under cooling operation in the heat pump type hot water supply apparatus of the embodiment.

Even when the hot-water supply operation is not needed under cooling operation, the pump 34 is turned on and the refrigerant and water are heat-exchanged with each other in the gas cooler 18. When a temperature sensor 48 secured to the refrigerant outlet port of the gas cooler 18 indicates a temperature value lower than the outside air temperature because the heat exchange is carried out in the gas cooler 18, the state of FIG. 3 is switched to a state as shown in FIG. 4 under which the first expansion valve 24 and the first electromagnetic valve 20 are closed and the second and third electromagnetic valves 46 and 28 are opened. In this case, the refrigerant cooled in the gas cooler 18 is not passed through the outdoor heat exchanger 22, but passed through the four-way branched passage 26 and the third electromagnetic valve 28, and it reaches to the user-side unit 14. Therefore, the cooling operation can be carried out in the user-side unit 14 while the outdoor heat exchanger 22 is not driven. The refrigerant flowing passage and the behavior of the refrigerant are the same as the case of FIG. 3, however, an extra part of the refrigerant returned to the heat-source side unit 12 flows into the outdoor heat exchanger 22 because the second electromagnetic valve 46 is opened, whereby the outdoor heat exchanger 22 can serve as a buffer.

As described above, when a large heat exchange amount is needed to rapidly cool the room or the like, the refrigerant passage is selected so as to flow from the gas cooler 18 to the outdoor heat exchanger 22. On the other hand, when a sufficient heat exchange amount can be secured through only the heat exchange in the gas cooler 18, the refrigerant passage is selected so as to flow from the gas cooler 18 to the indoor units (38*a*, 38*b*) without passing through the outdoor heat exchanger 22. Therefore, the air conditioning operation can be properly carried out in accordance with a needed heat exchange amount.

Second Embodiment

Figure 5:
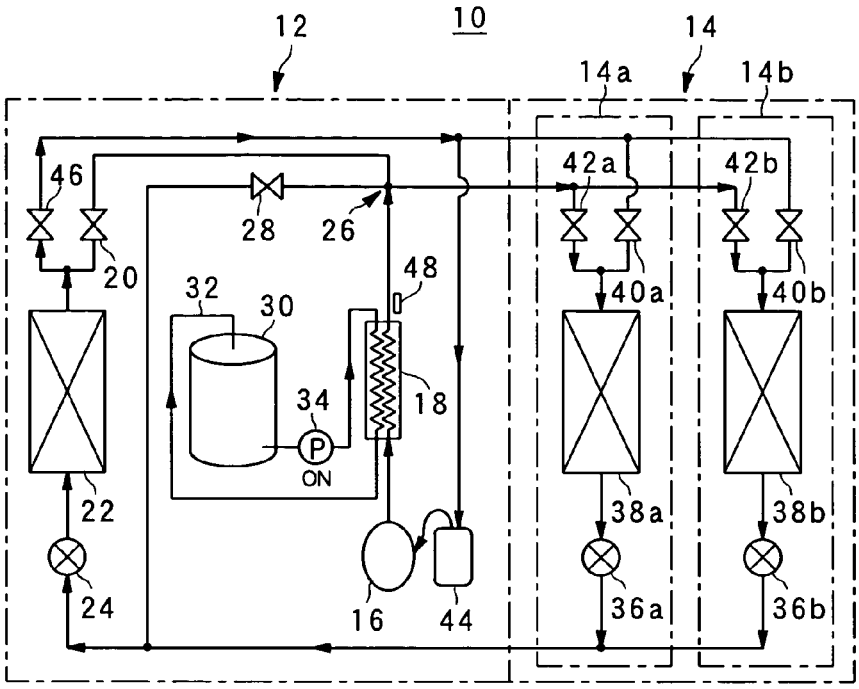
FIG. 5 is a refrigerant circuit showing refrigerant flow under heating operation in the heat pump type hot water supply apparatus of the embodiment.

When the heating operation is carried out, as shown in FIG. 5, the first and second expansion valves 24, 36*a*, 36*b* are opened, the first, third and fourth electromagnetic valves 20, 28, 40*a*, 40*b* are closed, and the second and fifth electromagnetic valves 46, 42*a*, 42*b* are opened. In this case, the refrigerant discharged from the compressor 16 is passed through the gas cooler 18. Conversely to the cooling operation, the first and third electromagnetic valves 20 and 28 are closed, so that the refrigerant flows into the fifth electromagnetic valves 42*a* and 42*b* and then is condensed in the indoor heat exchangers 38*a*, 38*b*. The condensation of the refrigerant in the indoor heat exchangers 38*a* and 38*b* allow the user-side unit 14 to carry but the heating operation. When only one indoor unit is driven to carry out the heating operation, the fifth electromagnetic valve 42 of the indoor unit which is not driven is closed.

The refrigerant condensed in the indoor heat exchangers 38*a*, 38*b* is passed through the first and second expansion valves 36*a*, 36*b* to the outdoor heat exchanger 22 and evaporated in the outdoor heat exchanger 22 because the third electromagnetic valve 28 is closed. The refrigerant thus evaporated is passed through the second electromagnetic valve 46 and returned to the compressor 16 through the accumulator 44 because the first and fourth electromagnetic valves 20, 40*a*, 40*b* are closed.

Under heating operation, if the refrigerant is cooled by the gas cooler, the heating capacity may be lowered. Accordingly, the driving of the pump is controlled in the flow-rate range of 0 to 100% in accordance with whether the hot water supply operation is required or not. That is, when the hot water supply operation is not required, the pump 34 is stopped.

Third Embodiment

Figure 6:
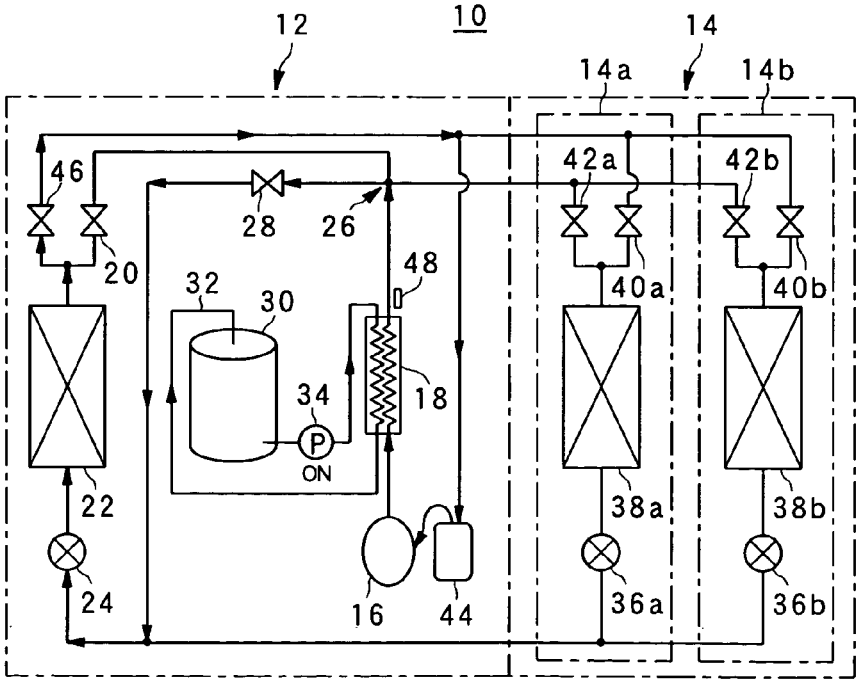
FIG. 6 is a refrigerant circuit showing refrigerant flow when only hot water operation is carried out in the heat pump type hot water supply apparatus.

When only the hot water supply operation is needed, as shown in FIG. 6, the first expansion valve 24 is opened, the second expansion valves 36*a* and 36*b* are closed, the first and fifth electromagnetic valves 20, 42*a* and 42*b* are closed, the first and fifth electromagnetic valves 20, 421*a*, 42*b* are closed, and the second, third and fourth electromagnetic valves 46, 28, 40*a*, 40*b* are opened. Therefore, the refrigerant is circulated in the heat-source side unit 12, and thus no refrigerant flows in the user-side unit 14.

The refrigerant discharged from the compressor 16 is heat-exchanged with water in the gas cooler 18, and condensed therein. The refrigerant thus condensed reaches the four-way branch passage 26, and flows to the third electromagnetic valve 28 because the first and fifth electromagnetic valves 20, 42*a* and 42*b* are closed. Thereafter, the condensed refrigerant reaches the refrigerant pipe through which the first and second expansion valves 24, 36*a* and 36*b* are connected to each other. Since the second expansion valves 36*a* and 36*b* are closed, the refrigerant flows to the first expansion valve 24, and it is evaporated in the outdoor heat exchanger 22. The refrigerant thus evaporated is circulated through the second electromagnetic valve 46 to the accumulator 44. At this time, extra refrigerant flows into the indoor heat exchanger 36 because the fourth electromagnetic valves 40*a* and 40*b* are opened, and thus the indoor heat exchangers 36 serve as buffers.

In the above embodiments, the constituent elements such as the electromagnetic valves, the temperature sensor, the expansion valves, the pump, etc. of the indoor units and the outdoor units are electrically connected to a controller 60 and controlled by the controller 60 as shown in FIG. 2. For example, on the basis of a detection result from the temperature sensor, the switching operation of each of the electromagnetic valves and the expansion valves is controlled by the controller 60 to select the circulating passage of the refrigerant in the refrigerant circuit. The illustration of the controller 60 is omitted from FIGS. 3 to 6, however, it is needless to say that the controller 60 is provided to the refrigerant circuit in the same manner as shown in FIG. 2.

In the above embodiments, $CO_2$ refrigerant is used as refrigerant. However, the present invention is not limited to this mode, and other refrigerant materials may be used.

What is claimed is:

1. A refrigerant circuit comprising:

a compressor for compressing refrigerant;

a first heat exchanger selectively functioning as any one of an evaporator and a condenser;

an expansion valve for reducing the pressure of the refrigerant;

a second heat exchanger selectively functioning as the other of the evaporator and the condenser, which are connected in series to one another to thereby circulate the refrigerant in the refrigerant circuit; and a third heat exchanger that heat exchanges the compressed refrigerant discharged from the compressor with heat-exchange fluid at all times and is equipped in the refrigerant circuit so as to be connected to the first heat exchanger in series in the refrigerant circuit, wherein the refrigerant circuit comprises a first refrigerant passage connecting the compressor, the third heat exchanger and the first heat exchanger in series, a second refrigerant passage that is connected to the third heat exchanger and bypasses the first heat exchanger, a third refrigerant passage connected to the second heat exchanger and the third heat exchanger, and a refrigerant passage switching unit for selecting at least one of flow of the refrigerant between the first refrigerant passage and the second refrigerant passage, flow of the refrigerant between the second refrigerant passage and the third refrigerant passage and flow of the refrigerant between the first refrigerant passage and the third refrigerant passage, wherein the refrigerant circuit further comprises a temperature detecting unit for comparing refrigerant temperature at a refrigerant outlet port of the third heat exchanger with the outside air temperature and a controller for controlling the switching operation of the switching unit on the basis of the comparison result.

2. The refrigerant circuit according to claim 1, wherein the heat-exchange fluid medium is water, and the third heat exchanger is a water heat exchanger for heat-exchanging the refrigerant discharged from the compressor with water to achieve hot water.

3. The refrigerant circuit according to claim 2, further comprising a hot water unit connected to the third heat exchanger to supply the third heat exchanger with water to be heat-exchanged with the refrigerant and stock hot water from the third heat exchanger.

4. A heat pump type hot water supply apparatus having the refrigerant circuit according to claim 1.

5. The heat pump type hot water supply apparatus according to claim 4, further comprising a hot water stock tank for stocking hot. water, wherein the hot water stock tank is connected to the water heat exchanger to supply water to the water heat exchanger so that the water supplied to the water heat exchanger is heat-exchanged with the refrigerant discharged from the compressor to be heated, thereby providing an air conditioning function and a hot water supply function to the heat pump type hot water supply apparatus.

6. The heat pump type hot water supply apparatus according to claim 5, wherein the refrigerant circuit contains a first refrigerant passage disposed between the water heat exchanger and the expansion valve so as to contain the outdoor heat exchanger, a second refrigerant passage disposed in the refrigerant circuit so as to bypass the outdoor heat exchanger, a third passage extending from a connection point between the first heat exchanger and the second refrigerant passage to the indoor heat exchangers, and a switching unit for selecting any one of the first, second and third passages.

7. The heat pump type hot water supply apparatus according to claim 6, wherein the switching unit comprises electromagnetic valves disposed in the first, second and third passages.

* * * * *